US006672735B2

(12) United States Patent
Dilger et al.

(10) Patent No.: US 6,672,735 B2
(45) Date of Patent: Jan. 6, 2004

(54) SUCTION HEAD FOR A SUCTION CLEANING DEVICE

(75) Inventors: Horst Dilger, Morsbach (DE); Dieter Kaffenberger, Wiehl (DE); Klaus-Dieter Riehl, Drolshagen (DE)

(73) Assignee: Wessel-Werk GmbH (DE)

( * ) Notice: Subject to any disclaimer, the term of this patent is extended or adjusted under 35 U.S.C. 154(b) by 0 days.

(21) Appl. No.: 09/863,083

(22) Filed: May 22, 2001

(65) Prior Publication Data

US 2002/0101730 A1 Aug. 1, 2002

(30) Foreign Application Priority Data

Jan. 29, 2001 (EP) ..... 01101956

(51) Int. Cl.[7] ..... A47L 9/30
(52) U.S. Cl. ..... 362/91; 362/800
(58) Field of Search ..... 362/91, 800, 234, 362/241, 555

(56) References Cited

U.S. PATENT DOCUMENTS

| | | | | |
|---|---|---|---|---|
| 4,728,942 A | | 3/1988 | England | 340/679 |
| 5,014,388 A | * | 5/1991 | Schiazza et al. | 15/339 |
| 5,561,346 A | * | 10/1996 | Byrne | 313/113 |
| 6,389,329 B1 | * | 5/2002 | Colens | 180/167 |

FOREIGN PATENT DOCUMENTS

| | | |
|---|---|---|
| DE | 198 11 738 | 9/1999 |
| EP | 0 231 419 | 8/1987 |
| EP | 0 755 850 | 1/1997 |
| JP | 2000-135187 | 5/2000 |

* cited by examiner

*Primary Examiner*—Sandra O'Shea
*Assistant Examiner*—Guiyoung Lee
(74) *Attorney, Agent, or Firm*—Collard & Roe, P.C.

(57) ABSTRACT

A suction head for a vacuum cleaning devices comprising an electrically operated brush roller and a lighting system for illuminating the working field. The lighting system contains a plurality of ultra-bright light-emitting diodes.

6 Claims, 2 Drawing Sheets

SUCTION HEAD FOR A SUCTION CLEANING DEVICE

BACKGROUND OF THE INVENTION

1. Field of the Invention

This invention relates to a suction head for suction cleaning devices having an electrically operated brush roller and a lighting system for illuminating the working field.

2. The Prior Art

In typical vacuum cleaners, suction heads are connected to the suction cleaning device via a suction tube and a flexible suction line. Suction cleaning devices are moved along the floor and contain a suction blower and a dust bag. The electrical part of the suction head is connected to an electrical system of the suction cleaning device by an electric line. Alternatively, the suction head may contain a rechargeable battery for operating its electrical system. In addition to these floor vacuum cleaners, combinations of suction heads and suction cleaning devices are known as upright suction cleaning devices. In this case, the suction cleaning device is pivot-mounted on the suction head via a short piece of tube and has a handle located on its rearward end. The electric motor of the brush roller and the lighting system of the suction head are connected to the electrical system of the main-operated suction cleaning device.

In some cases, the suction head for floor vacuum cleaners and the suction head for upright suction cleaning devices are equipped with a lighting system for illuminating the working field. These lighting systems comprise an incandescent bulb or a fluorescent bulb. However, both of these lighting systems have drawbacks. Incandescent lights become hot during operation, requiring cooling and safety shutoff devices in the event of overheating. However, the available installation space for the safety devices is very small. Furthermore, the area for installing electric bulbs has to be adequately resistant to heat. Electric coils that are operated at main voltage and rated for low outputs, are extremely thin and sensitive to shock. Therefore, a stabilizing fixture to prevent shock is required to assure a useful life. Fluorescent lights are preferred because these lamps supply a higher intensity light and are less sensitive to shocks. However, such lamps require a larger installation space and a light window in the suction head having large dimensions. The fluorescent lamp is conventionally controlled via an impeder and a starter, or by an electronic device connected in series. The disadvantage of both these systems is that they require a lot of time to build.

SUMMARY OF THE INVENTION

An object of the present invention is to provide an improved lighting system on a suction head of a vacuum cleaner for illuminating the working field. This lighting system supplies strong light and is shock resistant. In addition, this system requires only a small installation space.

These and other objects are accomplished by providing a suction head for suction cleaning devices having a system of lighting elements. The lighting elements comprise a plurality of ultra-bright light-emitting diodes with a light intensity of more than 1000 mCd (milli candela). In a preferred embodiment, ultra-bright light-emitting diodes with a light intensity in excess of 3000 mCd are provided. To achieve higher light yields with directed light emission, the light-emitting diodes (LED-chips), are mounted in a punched reflector by a conductive adhesive. The reflector forms the cathode in most cases. The anode is contacted by a gold or aluminum wire. The system is accommodated in a plastic housing. The optical light emission of the light-emitting diode is fixed by the geometry of the reflector, the shape of the plastic housing and the position of the LED-chips within the housing.

The lighting system according to the present invention may have ultra-bright light-emitting diodes that can emit a very bright light, which at times is perceived as cold and not very pleasant. Therefore, the color of the light can be varied by adding light-emitting diodes emitting monochromatic light of different wavelengths to provide a mixed color. In another embodiment, the lighting system comprises ultra-bright light-emitting diodes that are arranged close to each other, and emit light in different monochromatic light colors to supply the desired light color by additive color mixing of the emitted light rays. In this case, two or three monochromatic colors are used, and their degrees of brightness are coordinated among each other. The lighting system can also be combined with ultra-bright white light-emitting diodes to generate a bright light in the desired light color.

The light-emitting diodes can be provided with a housing having an integrated lens for focusing the light rays. The preferred ultra-bright light-emitting diodes have a reflection angle between 20° and 30° and a light intensity of 3000 to 5000 mCd.

Light-emitting diodes with high light intensity offer a number of advantages when used on a vacuum cleaner. For example, the light-emitting diodes are small, shock-proof, and their useful life is practically unlimited. In addition, very little heat is emitted from the diodes, and they are cost-effective. The required first voltage range can be easily generated due to the very low power consumption of the light-emitting diodes.

Single light-emitting diodes are not sufficient for illuminating the working field in front of the suction head. Therefore, in a preferred embodiment of the invention, the lighting system comprises 5 to 10 light-emitting diodes consisting of groups of light-emitting diodes in different colors for illuminating the working field. The light-emitting diodes are arranged in a fan-like formation for producing a light cone. The angles of reflection between neighboring light-emitting diodes are about 5° to 10°. This formation results in a brightness that is higher than that of an incandescent lamp. Reflectors are not required because of the directed light emission of the ultra-bright light-emitting diodes. Therefore, the lighting system can be accommodated on the front side of the suction head in a simple and space-saving manner.

BRIEF DESCRIPTION OF THE DRAWING

Other objects and features of the present invention will become apparent from the following detailed description considered in connection with the accompanying drawing. It is to be understood, however, that the drawing is designed as an illustration only and not as a definition of the limits of the invention.

DETAILED DESCRIPTION OF THE PREFERRED EMBODIMENT

Figure 1:
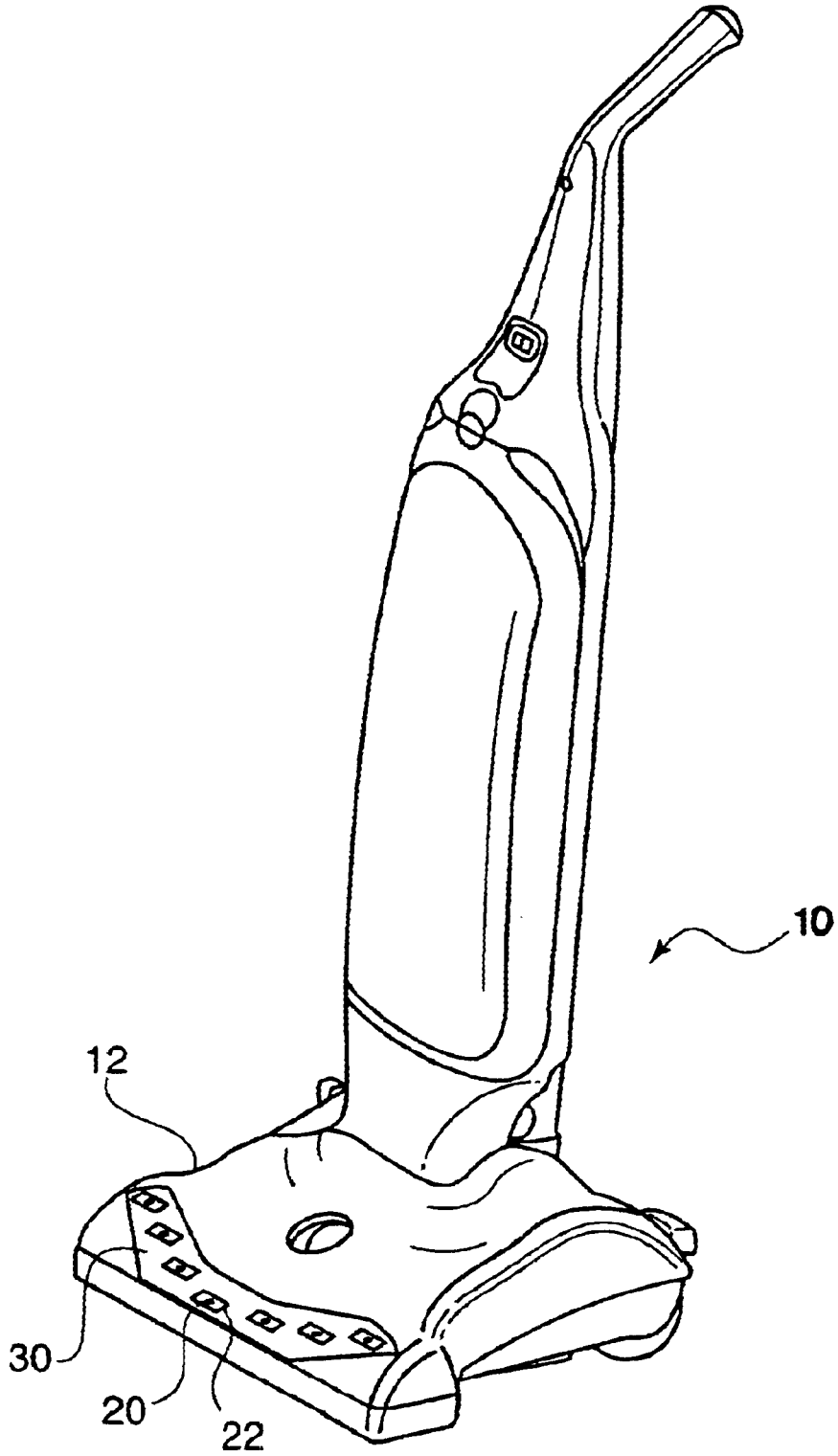
FIG. 1 shows a vacuum cleaner with light emitting diodes.

Referring now in detail to the drawing and, in particular, FIG. 1 shows a vacuum cleaner 10 having a suction head 12.

Suction head 12 contains a lighting system comprising a plurality of light emitting diodes (LED) 20. The LEDs are arranged in a fan-like formation to produce a light cone. The angles of reflection are preferably about 5° to 10°.

LEDs 20 are disposed in a plastic housing 30. LEDs 20 are mounted onto a punched reflector 22 by a conductive adhesive. Reflector 22 forms a cathode and the anode is contacted by a wire (not shown).

The lighting system contains ultra-bright LEDs that emit a very bright light. However, the color can be varied by adding diodes of monochromatic light of different wavelengths to provide a mixed color.

Figure 2:
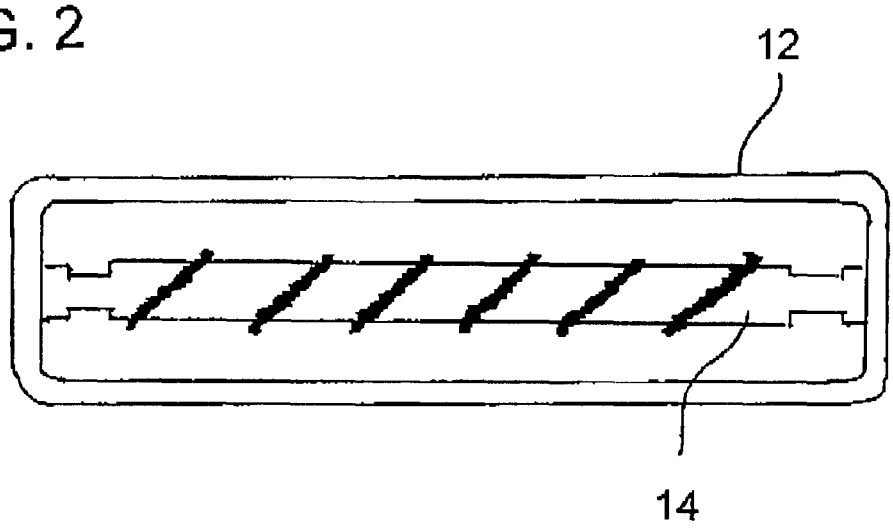
FIG. 2 shows a bottom view of the suction head of the vacuum cleaner.
Figure 3:
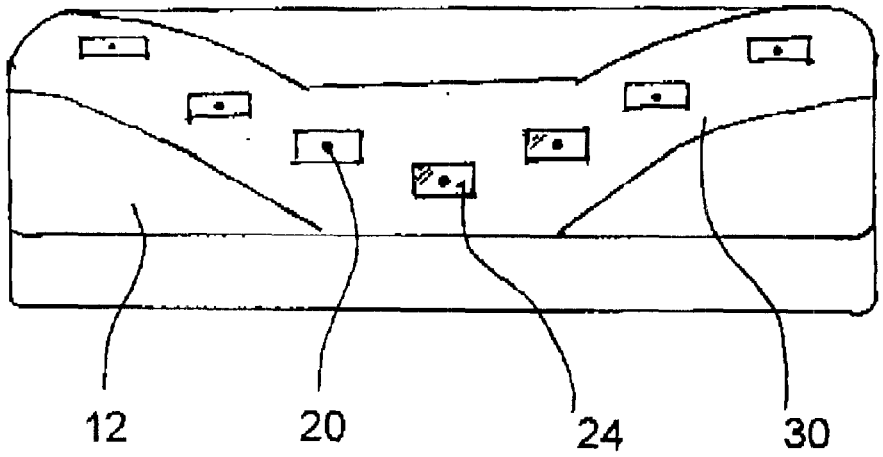
FIG. 3 shows a front view of the suction head of the vacuum cleaner.

FIG. 2 shows a bottom view of suction head 12 of vacuum cleaner 10. An electrically operated brush 14 roller is within suction head 12 of vacuum cleaner 10. FIG. 3 shows a front view of suction head 12 of vacuum cleaner 10. LEDs 20 have an integrated lens 24 for focusing the light rays.

Accordingly, while only a single embodiment of the present invention has been shown and described, it is obvious that many changes and modifications may be made thereunto without departing from the spirit and scope of the invention.

What is claimed is:

1. A vacuum cleaning device comprising:

a suction head having a front surface and in connection with an electrical system of a vacuum cleaner wherein said suction head moves along a surface in a working field;

an electrically operated brush roller disposed within said suction head; and a lighting system on said front surface of said suction head comprising a plurality of ultra-bright white light-emitting diodes and additional diodes for monochromatic light of different wavelengths, wherein said lighting system provides a bright light in a desired light color for illuminating said surface in said working field.

2. The vacuum cleaning device according to claim 1, further comprising:

a housing surrounding said lighting system; and an integrated lens for focusing light rays of said light-emitting diodes and said additional diodes.

3. The vacuum cleaning device according to claim 1, wherein said light-emitting diodes and said additional diodes are arranged in a fan-like formation producing a light cone.

4. The vacuum cleaning device according to claim 3, wherein adjacent light-emitting diodes are aligned at an angle of 5° to 10° with respect to each other.

5. A vacuum cleaning device comprising:

a suction head having a front surface in connection with an electrical system of the vacuum cleaner, wherein said suction head moves along a surface in a working field;

an electrically operated brush roller disposed within said suction head; and a lighting system disposed on said front surface of said suction head and comprising a plurality of ultra-bright light-emitting diodes that are arranged close to each other and emit light in different monochromatic light colors to supply a desired color by additive color mixing of emitted light rays, wherein said lighting system illuminates said surface in said working field.

6. A vacuum cleaning device comprising:

a suction head having a front surface and in connection with an electrical system of a vacuum cleaner, wherein said suction head moves along a surface in a working field;

an electrically operated brush roller within said suction head; and a lighting system disposed on said front surface of said suction head without a reflector in a simple and space-saving manner, wherein said lighting system comprises a multitude of ultra-bright light-emitting diodes for illuminating said surface in said working field;

wherein said light-emitting diodes are arranged in a fan-like formation with adjacent light-emitting diodes aligned at an angle of 5° to 10° with respect to each other producing a light cone.

* * * * *